US006149473A

United States Patent [19]

Lalange et al.

[11] Patent Number: 6,149,473

[45] Date of Patent: Nov. 21, 2000

[54] CONNECTOR WITH SECONDARY LOCKING AND COUPLING MECHANISM

[75] Inventors: Jacques Lalange, Pontoise; Olivier Pamart, Ecouen, both of France

[73] Assignee: The Whitaker Corporation, Wilmington, Del.

[21] Appl. No.: 09/402,960

[22] PCT Filed: Apr. 9, 1998

[86] PCT No.: PCT/IB98/00524

§ 371 Date: Dec. 16, 1999

§ 102(e) Date: Dec. 16, 1999

[87] PCT Pub. No.: WO98/47204

PCT Pub. Date: Oct. 22, 1998

[30] Foreign Application Priority Data

Apr. 15, 1997 [FR] France ..... 97 400855

[51] Int. Cl.[7] ..... H01R 13/62; H01R 13/40; H01R 13/58

[52] U.S. Cl. ..... 439/752; 439/310; 439/595; 439/157; 439/466

[58] Field of Search ..... 439/752, 310, 439/595, 157, 466, 364, 451

[56] References Cited

U.S. PATENT DOCUMENTS

| | | | |
|---|---|---|---|
| 4,944,688 | 7/1990 | Lundergan | 439/275 |
| 5,489,224 | 2/1996 | Scwardz | 439/752 |
| 5,681,184 | 10/1997 | Pamart et al. | 439/595 |
| 5,839,923 | 11/1998 | Yoshida | 439/752 |
| 6,010,374 | 1/2000 | Miwa | 439/752 |
| 6,036,509 | 3/2000 | Maejima | 439/157 |

FOREIGN PATENT DOCUMENTS

| | | |
|---|---|---|
| 0 726 617A2 | 8/1996 | European Pat. Off. . |
| 197 04 356A1 | 8/1997 | Germany . |

OTHER PUBLICATIONS see PCT International Search Report for any references that are not enclosed herewith.

*Primary Examiner*—Paula Bradley
*Assistant Examiner*—Edwin A. León

[57] ABSTRACT

A connector assembly having a secondary locking member and a slide coupling member includes interengaging features between the slide coupling member and secondary locking member whereby the slide coupling member cannot be activated unless the secondary locking member is in its fully locked position and the secondary locking member further comprises extensions extending beyond a terminal receiving end wall of the connector housing to enable the secondary locking member to be manually depressed from the fully locked to the preassembly position so that it is particularly simple to repair the connector, for example when removal and reinsertion of terminals is required.

8 Claims, 6 Drawing Sheets

CONNECTOR WITH SECONDARY LOCKING AND COUPLING MECHANISM

BACKGROUND OF THE INVENTION

1. Field of the Invention

This invention relates to an electrical connector having a secondary locking mechanism for locking terminals within cavities of the connector.

2. Summary of the Prior Art

Such a connector is described in U.S. Pat. No. 4,944,688. The connector disclosed therein includes a secondary locking member which is slideable along the connector housing form a pre-assembly position to a fully locked position. The secondary locking element does have keying platforms and integral latches to fix it to the main housing.

An electrical connector having a secondary locking mechanism and further comprising a coupling member for assisting coupling of the connector to a complementary connector is described in European Patent 726 617. The connector disclosed therein has an insulative housing with a plurality of electrical terminals mounted therein and locked with first (primary) retention means such as resilient locking lances of the housing engaging in cavities of the terminals, the housing further provided with a secondary locking member that allows assembly of the terminals within the housing when in a preassembly position. The secondary locking member is movable to a locked position to secure the terminals in the housings with secondary locking means. The connector is further provided with a camming slide that engages with complementary members of a mating connector for coupling the connectors together. The coupling member reduces the forces required for mating. The coupling member further cooperates with the secondary locking member such that it is not movable until the secondary locking member is in the fully locked position. This ensures that connectors cannot be coupled unless the terminals are correctly mounted within their respective cavities and securely locked with primary secondary locking means. A particularly reliable connection assembly is thus provided. A further advantage is that the camming slide cannot be moved to the wrong position during handling and transport, as it is blocked by the secondary locking member prior to complete assembly of terminals within the connector.

One of the problems of the problems of the above described connector system, which is also a problem of many other connectors with secondary locking members with or without camming slides, is that once the secondary locking member has been pushed to the fully locked position it is difficult to disengage. In particular, it is typical that special tooling is required to move the secondary locking member from the fully locked to the preassembly position. Once the secondary locking member is in the fully locked position it is desirable that it cannot be easily disengaged as this may reduce the reliability of the connection assembly if this could occur accidentally. The use of a special tool however may lead to damage of the connector if it is not correctly utilized by a technician, and furthermore increases the costs of repair or maintenance of the connection system.

It would be desirable to reduce the maintenance and repair costs of a connection assembly, without reducing its reliability. It would also be particularly advantageous to combine such effects into a connection assembly as described in European Patent 726 617.

SUMMARY OF THE INVENTION

It is an object of this invention to provide an improved electrical connector with secondary locking means. It would be particularly advantageous to provide such connector with a coupling assist mechanism cooperating with the secondary locking mechanism such as described in EP 726 617.

Objects of this invention have been achieved by providing the connector assembly according to claim 1. Disclosed is an electrical connector comprising a housing and electrical terminals mounted therein, a secondary locking member mountable to the housing in a first preassembly position where the terminals can be inserted and locked into their corresponding cavities, the secondary locking member movable to a fully locked position to securely lock the terminals in their cavities with secondary locking means, the connector further comprising a coupling assist mechanism for assisting coupling with a mating connector, the coupling assist member and secondary locking member interengaging when the secondary locking member is in a preassembly position to prevent movement of the coupling assist member, wherein the secondary locking member comprises a release projection extending through a wall of the connector when the secondary locking member is in the fully locked position the release projection being manually engagable for displacing the secondary locking member from the fully locked to the preassembly position. Advantageously therefore, the secondary locking member can be easily released to the preassembly position for cost-effective maintenance of the connector.

The connector may advantageously comprise complementary shoulders on the secondary locking and coupling assist member that engage once the secondary locking member is in the fully locked position and the coupling assist mechanism is moved from its preassembly position, the shoulders engaging such that the secondary locking mechanism cannot be moved from the fully locked to the preassembly position once the coupling assist mechanism has been displaced out of its preassembly position. The latter ensures that a particularly reliable electrical connection is provided whereby the secondary locking mechanism cannot be unlocked during coupling with a complementary connector or thereafter. The latter also ensure that the coupling assist mechanism is moved to the preassembly position prior to unlocking of the secondary locking member.

The secondary locking member release projections may be provided as projections extending in a direction of coupling of the connectors beyond an end wall at a terminal receiving end of the connector housing. The projections may be provided extending adjacent a terminal receiving portion of the housing extending beyond the terminal receiving end such that they do not extend substantially beyond an end face of the housing in order to prevent accidental release.

Further advantageous aspects of this invention are described in the claims or will be apparent from the following description and drawings.

DETAILED DESCRIPTION OF THE PREFERRED EMBODIMENT

Figure 1:
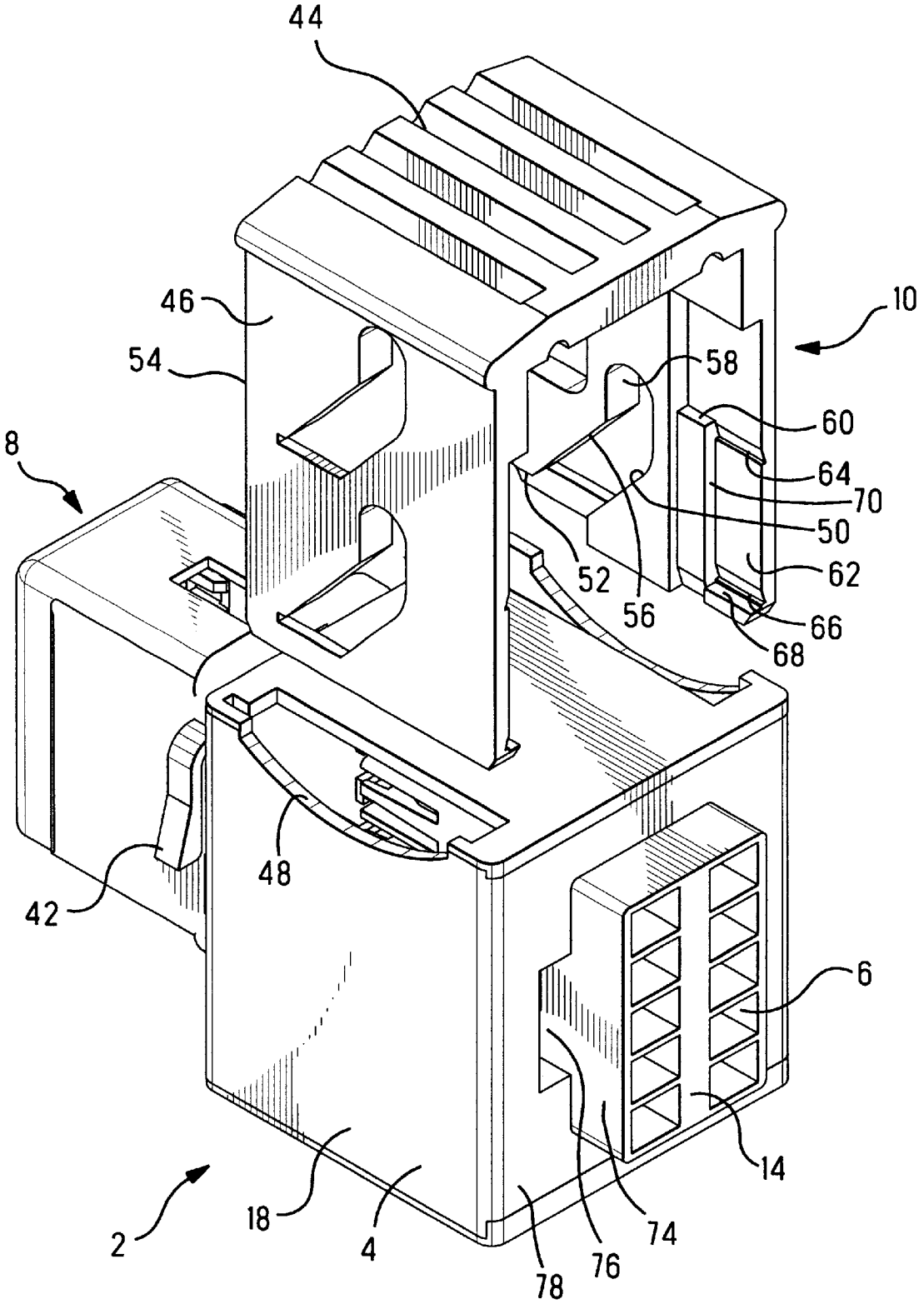
FIG. 1 is an isometric view of an embodiment of this invention with secondary locking and slide-lock coupling members exploded away.

Referring to FIG. 1, an electrical connector 2 comprises an insulative housing 4 having cavities 6 for receiving electrical terminals therein, a secondary locking member 8 and a slide-lock coupling member 10.

Figure 2:
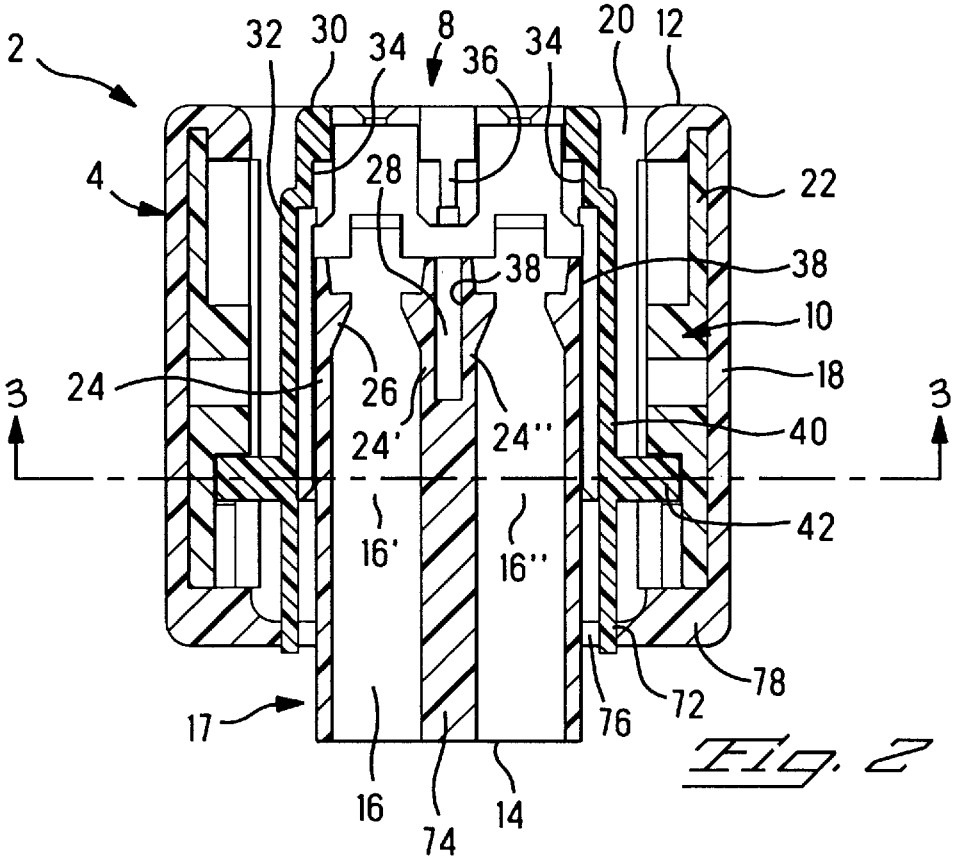
FIG. 2 is a cross-sectional view through the connector with the slide-lock coupling member in a fully locked position and the secondary locking member in a preassembled position.
Figure 3:
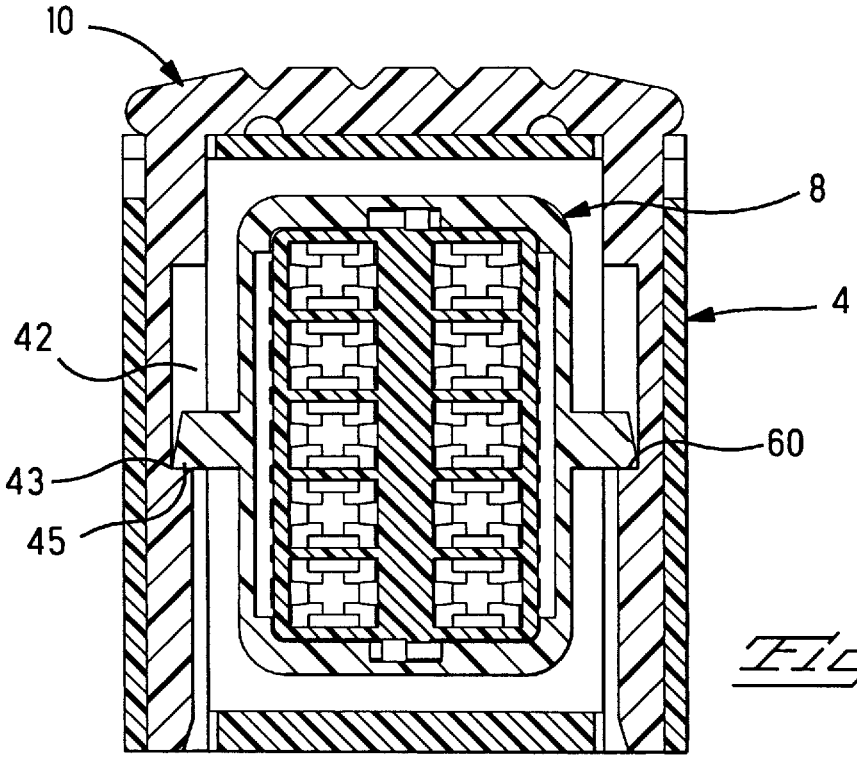
FIG. 3 is a cross-sectional view through lines 3—3 of FIG. 2.

Referring to FIGS. 1–3, the housing 4 extends between a mating face 12 and a terminal receiving face 14, the housing having a terminal receiving section 17 which is surrounded by a shroud 18 and separated therefrom by a cavity section 20 within which the secondary locking member 8 and arms 22 of the slide-lock coupling member 10 are received. The housing terminal section 17 comprises resilient locking lances 24 integrally moulded therewith, the locking lances 24 in the shape of cantilever beams and having locking protrusions 26 proximate their free ends that project into the terminal receiving cavities 16. Electrical terminals can be inserted into the cavities 16 whereby passage of the terminals past the locking lance protrusions 26 causes resilient outward biasing of the locking lances until engagement of the protrusions 26 behind shoulders of the terminals to prevent removal of the terminals from their corresponding cavities 16 towards the terminal receiving end 14. Adjacent locking lances 24',24" of adjacent cavities 16',16" are separated by a slot 28 to allow outward biasing of the lances during mounting of the electrical terminals within their corresponding cavities.

Figure 4:
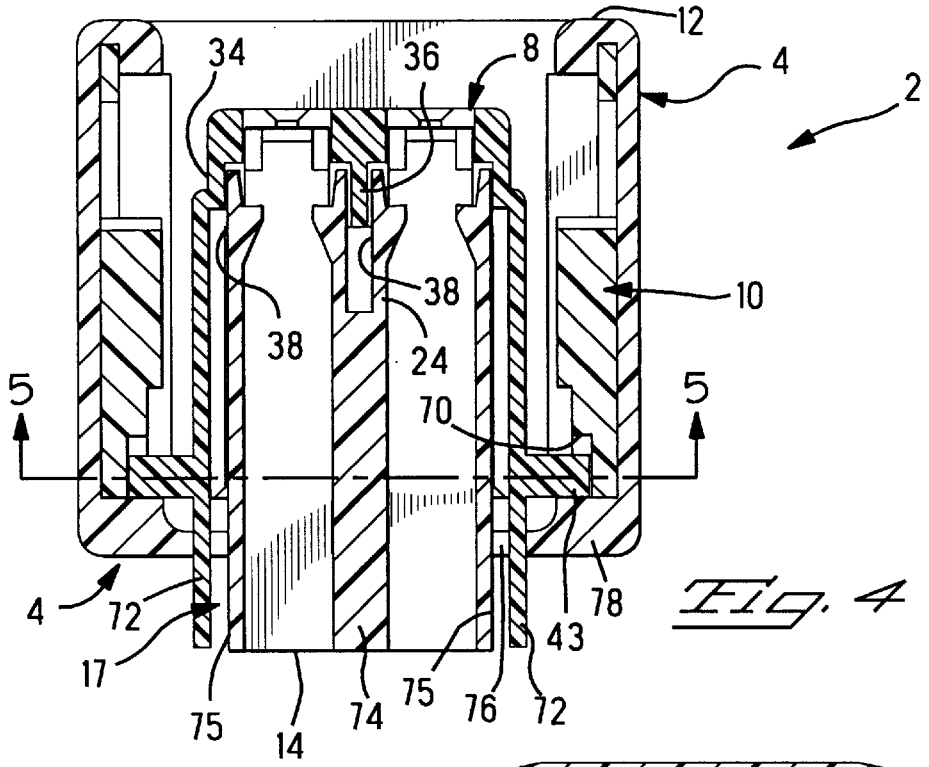
FIG. 4 is a similar view to that of FIG. 2, but with the slide-lock member in a fully open position and the secondary locking member in a fully locked position.
Figure 8:
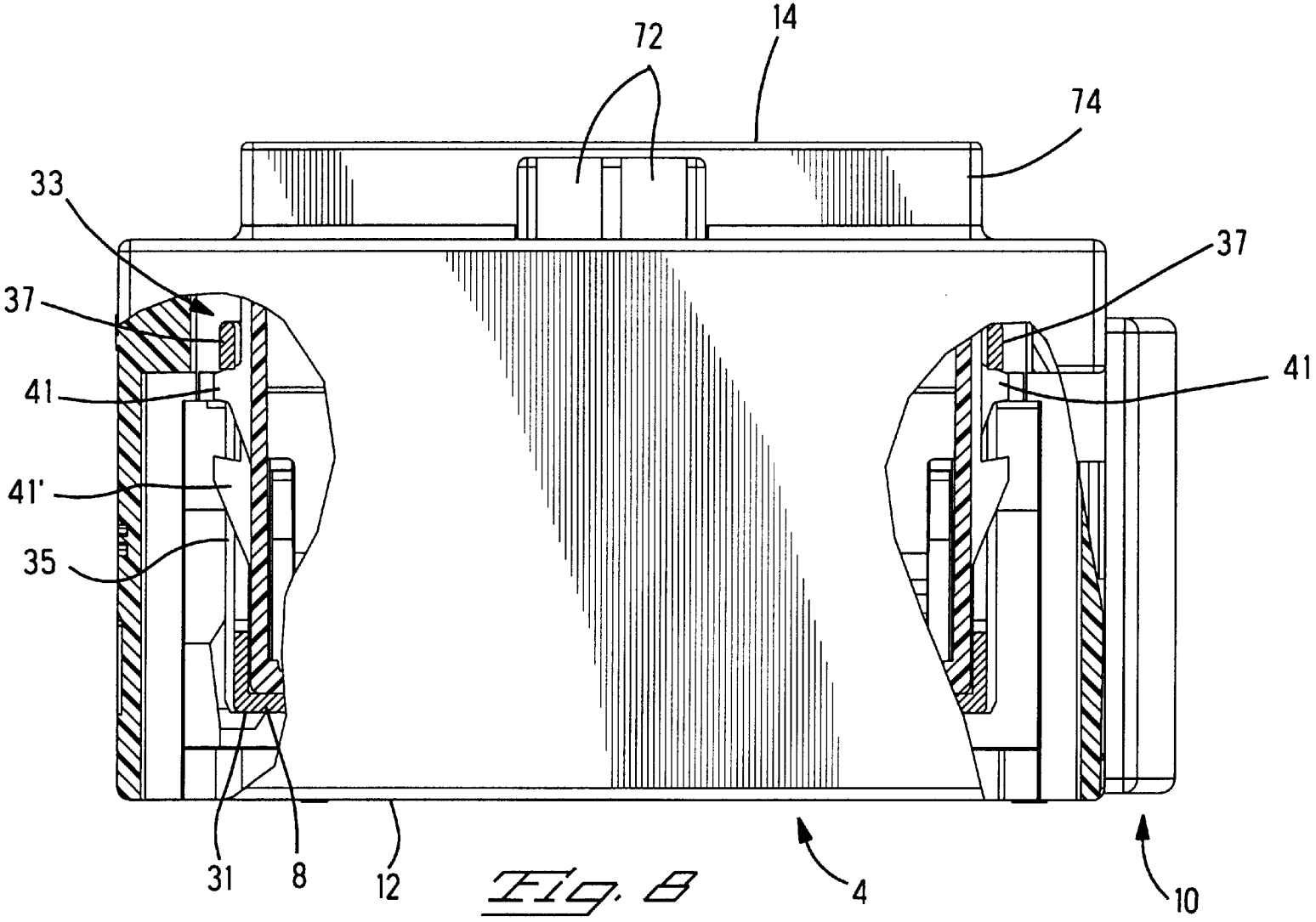
FIG. 8 is a side view of the embodiment of FIGS. 6 and 7, with partial cross-sections, where the secondary locking member is in the fully locked position.
Figures 9, 10:
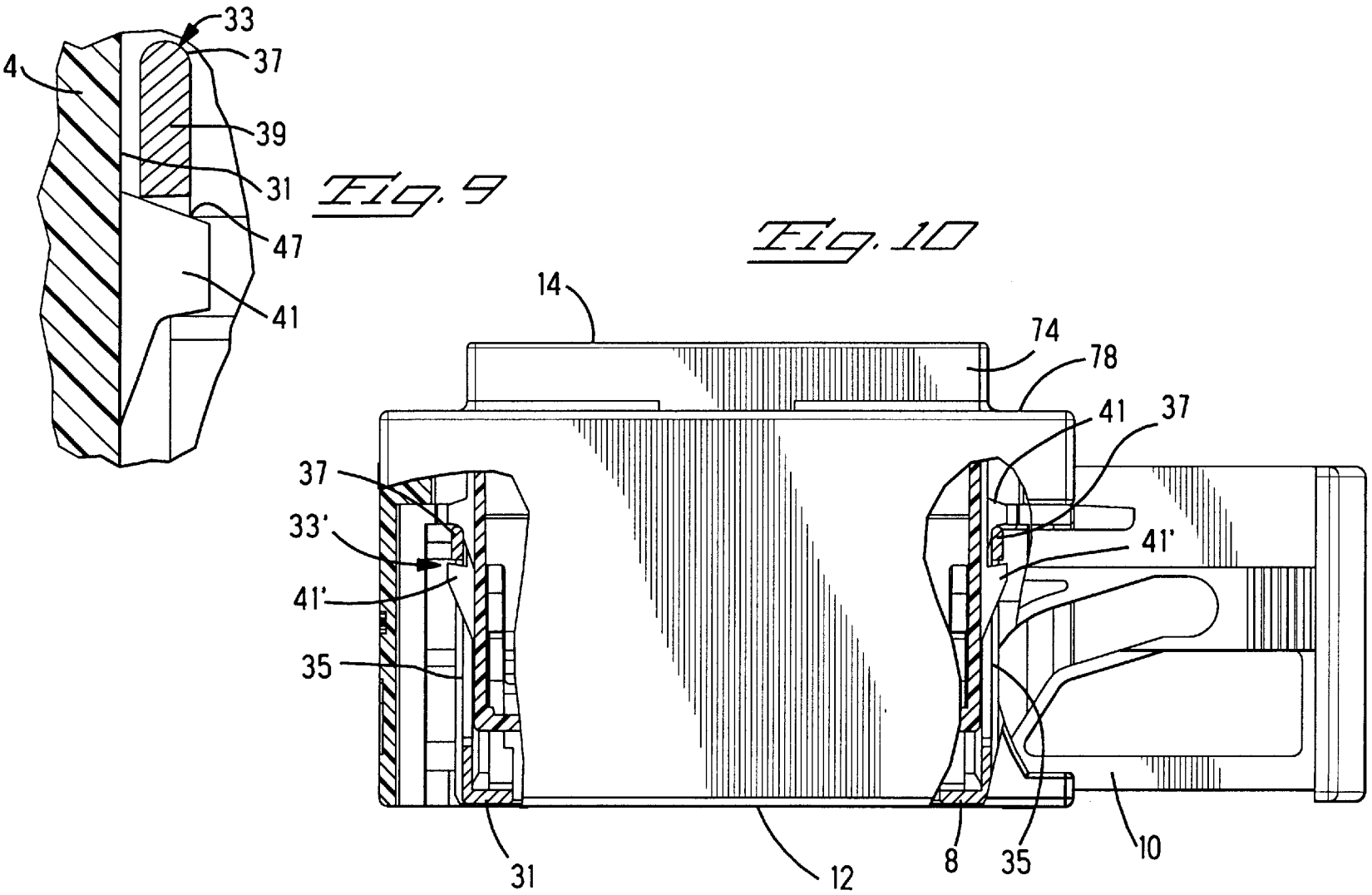
FIG. 9 is a detailed view of the latching means between the secondary locking member and the housing.
FIG. 10 is a view similar to FIG. 8 with the secondary locking member in the preassembly position.

The secondary locking member 8 comprises a mating end wall 30 and extending therefrom a shroud 32 that fits over the mating end of the housing terminal receiving section 16. Also extending from the mating end wall 30 are short wall portions 34,36 that are positioned adjacent outer surfaces 38 of the locking lances 24 when the secondary locking housing 8 is in the fully locked position with respect to the housing 4 as shown in FIG. 4. The wall portions 34,36 thus prevent outward biasing of the locking lances 24,24',24" in order to securely lock the terminals that have been inserted into the cavity 16 and that have engaged with the locking protrusions 26 of the locking lances 24. In FIGS. 2 and 10, the secondary locking housing 8 is shown in the preassembly position whereby the wall portions 34,36 are disengaged from the locking lances outer surfaces 38 such that the locking lances are free to bias outwardly for reception of terminals within the cavity 16. The secondary locking housing is held in the preassembly position by a latching means 33' shown in FIG. 10 which maintains the member 8 in the preassembly position, the secondary locking member however being depressable under application of a certain force for snapping into the fully locked position as shown in FIGS. 4 and 8–9 where the latch means 33 securely hold the secondary locking member in this position. The latching means 33,33' comprises a resilient cantilever beam latch 35 integral with the secondary locking member extending from a mating end 31 of the secondary locking member to a free end 37 provided with a latch shoulder 39 that engages a corresponding preassembly latching protrusion 41' or locking latching protrusion 41 projecting from an end wall of the housing 4. The locking protrusion 41 is provided with an oblique locking shoulder 47 that enables disconnection of the secondary locking member from the fully locked position to the preassembly position. In other words, when the secondary locking member is pushed from the fully locked to the preassembly position the oblique locking shoulder 45 allows the latch free end 37 to resiliently outwardly bias and pass over the locking protrusion 41. The preassembly protrusion 41' is provided on the housing for engaging with the latch 35 of the secondary locking member in the preassembly position in a secure manner. The secondary locking member cannot be removed from the housing without special tools.

The secondary locking member 8 further comprises locking arms 42 attached to a lower portion 40 of the shroud 32.

Figure 5:
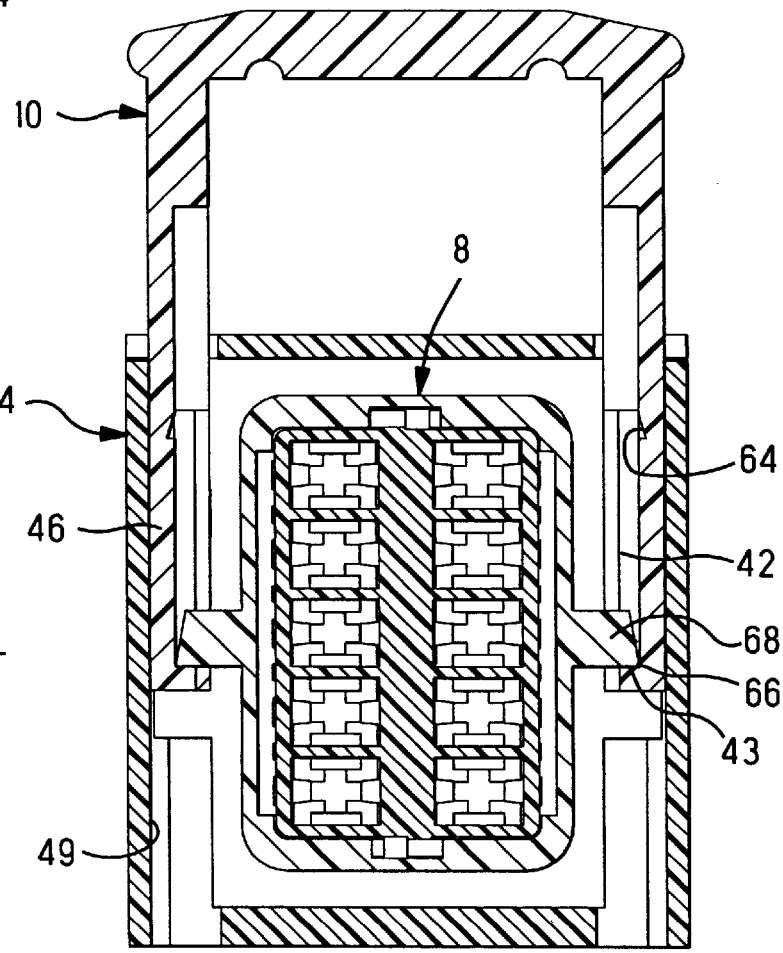
FIG. 5 is a cross-sectional view through lines 5—5 of FIG. 4.
Figure 6:
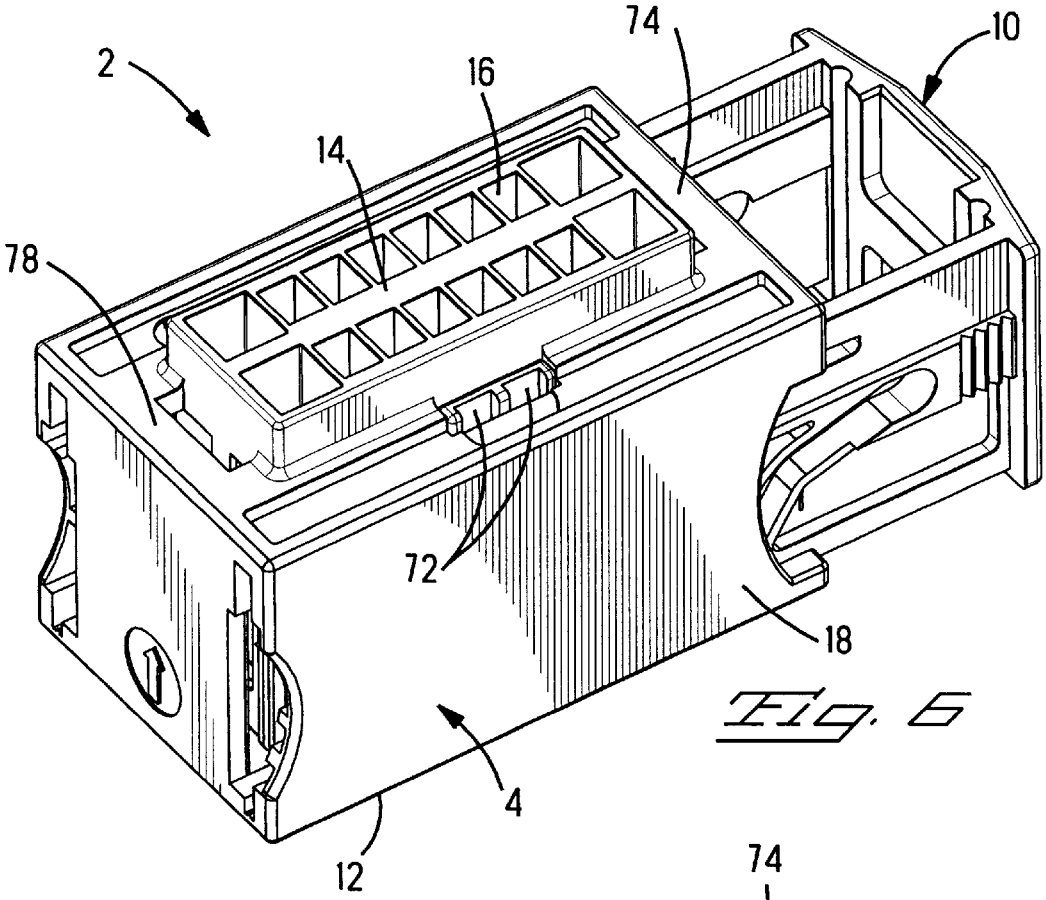
FIG. 6 is an isometric view of an embodiment of this invention with secondary locking and slide lock coupling members viewing in a direction towards a terminal receiving end, where the secondary locking member is in the preassembly position.
Figure 7:
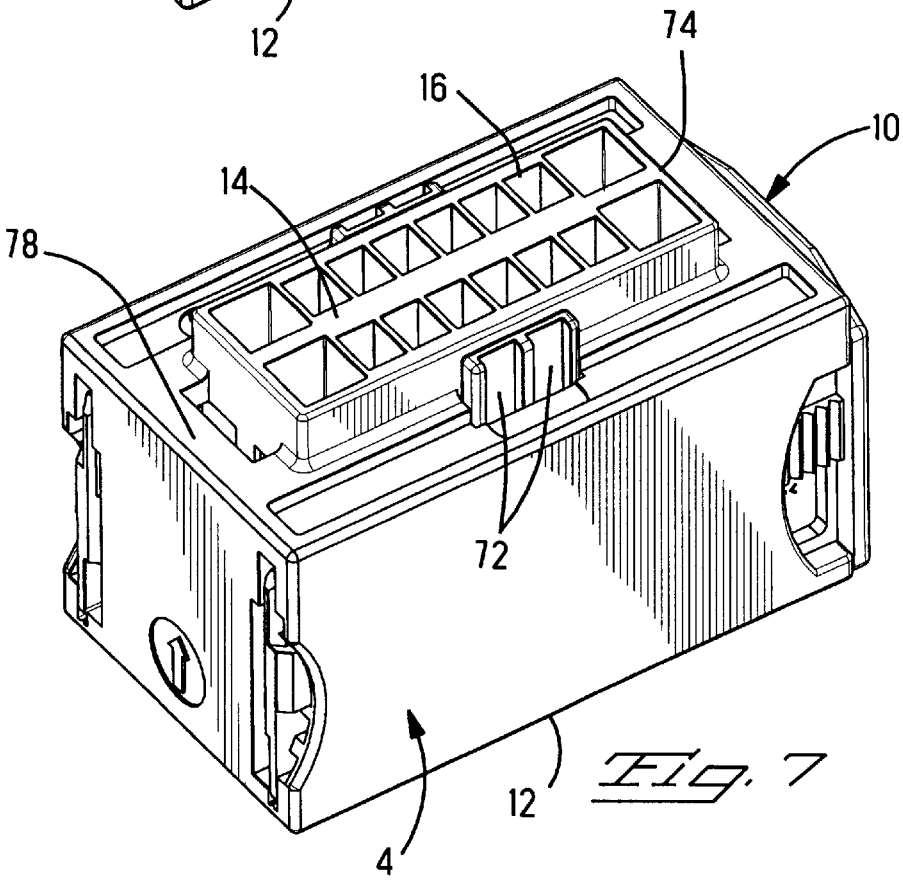
FIG. 7 is a view similar to FIG. 6 with the secondary locking member in the fully locked position.

Referring to FIG. 1, the slide-lock coupling member 10 comprises a U-shaped body having a base wall 44 and side walls 46 extending laterally therefrom, the side walls 46 insertable through cutouts 48 in the connector housing shroud 18 to slide adjacent an inner surface 49 of the shroud 18 (also see FIG. 5). The slide-lock coupling member side walls 46 comprise camming slots 50 that have a first longitudinal portion 52, extending from a complementary connector receiving end 54, the longitudinal portion 52 extending into an oblique portion 56 which then extends into a portion orthogonal to the longitudinal direction (where the longitudinal direction is the direction of coupling of the connector 2 to a complementary connector). The camming slots 50 are for receiving studs of a complementary connector (not shown), in order to draw the complementary connector towards the connector 2 when the slide-lock coupling member 10 is moved from the open position as shown in FIG. 5 to the closed position as shown in FIG. 3. The latter thus causes coupling of the connector 2 to the complementary connector. Before sliding from the open to the closed position, the slide-lock coupling member 10 receives the studs of the complementary connector first into the longitudinal portion 52 of the camming slot 50, which allows initial engagement of the connector to the complementary connector. If the slide-lock coupling member 10 is in the closed position prior to coupling to the complementary connector, the studs of the complementary connector cannot enter into the camming slot lead-in portion 52 and simply abuts the complementary connector receiving end 54 of the side walls 46, thus preventing coupling of the connectors. The end portion 58 of the camming slots 50 is contiguous the complementary connector studs when the slide-lock coupling member 10 is in the fully closed position, and due to the orthogonal direction of the portion 58 with respect to the coupling direction of the connectors, a force tending to pull apart the connectors will not produce a force component in the orthogonal direction and thus cannot open the slide-lock member and release the connectors from the mating position.

The slide-lock member 10 further comprises a preassembly locking shoulder 60 (see FIGS. 1 and 3) on the inner surface of the side walls 46, against which latching protrusions 43 at ends 45 of the secondary locking member locking arms 42 engage, when in the preassembly position as shown in FIG. 3. During assembly of the terminals into the housing cavities 16, the secondary locking member 8 is in the preassembly position and the slide-lock member 10 is in the fully closed position as shown in FIG. 3, whereby the spring arm protrusions 43 engage with the shoulder 60. The slide-lock member 10 can thus not be moved into the open position and can therefore not be coupled to a complementary connector.

It would also be possible to have an embodiment where the slide-lock member is locked in the open position by engagement with the secondary locking member to prevent coupling, rather than locked in the closed position as shown in the embodiment of FIGS. 1–5.

Adjacent the shoulder 60 extends a recess 62 having a closed position notch 64 extending proximate the shoulder 60 and a preassembly position notch 66 proximate ends of the side walls 46 distant from the end wall 44. Proximate the open position notch 66 is a retention shoulder 68 for engagement with the latching protrusions 43 to prevent removal of the slide-lock member 10 from the housing 4 as shown in FIG. 5. When the secondary locking member 8 is moved from the preassembly position shown in FIG. 2 to its fully locked position shown in FIG. 4, the latching protrusion 43 disengages from the shoulder 60 and moves into the recessed area 62 to engage in the closed position notch 64. The notch 64 engages with the latching protrusion 43 to provide a certain resistance to moving the slide-lock member 10, but if sufficient force is applied to the slide-lock member, it can be drawn to the open position as shown in FIG. 5 where the latch protrusion 43 engages in the open position notches 66 for provisionally holding the slide-lock member in the open position. The connector 2 can thus be coupled to the complementary connector and the slide-lock member 10 is then depressed to the fully closed position, thereby drawing the connectors together and coupling them. In the closed position, the slide-lock member 10 is latched with a certain force by engagement of the notches 64 with the spring beam latch protrusions 43.

Once the slide lock member has been moved from its preassembly position where it is locked by the latch protrusion 43 (where the slide lock member may either be in the open or closed position depending on the choice of the embodiment as described above), the secondary locking member 8 cannot be moved to the preassembly position. The latter occurs by virtue of engagement of the latching protrusion 43 with an upper shoulder 70 as best seen in FIGS. 1 and 4, of the slide lock member 10. Therefore, once coupling of the connectors is permitted by movement of the secondary locking member to the locked position, and the slide lock member 10 is displaced for example during coupling of mating connectors, it is no longer possible to accidentally displace the secondary locking member out of its fully locked position.

The secondary locking member 8 further comprises actuators 72 extending from side walls thereof alongside a terminal receiving portion 74 of the housing 4. The actuators 72 project through cavities 76 of a terminal receiving end wall 78 opposed to the mating end 12 of the connector. The terminal receiving end wall 78 is spaced at a certain distance from the outermost terminal receiving end 14 of the housing, which defines the end of the terminal receiving portion 74 of the housing. When the secondary locking member is in the fully locked position as shown in FIG. 4, the actuators 72 extend to a position proximate the terminal receiving end 14 of the housing portion 74 such that they can be manually activated (for example by hand) in order to displace the secondary locking member back to its preassembly position as shown in FIG. 2. In the latter position, the extensions 72 may be positioned substantially at the end walls 78 or in the proximity thereof.

As mentioned previously, the secondary locking member 8 cannot be activated until the slide lock member 10 is in its preassembly position, which may be the open or closed position depending on the chosen embodiment. Referring mainly to FIGS. 8–10, the secondary locking member latching features 35,37 that cooperate with the locking protrusion 41 provides a certain resistance, in view of the oblique latching surface 47 to displacement of the secondary locking member to the preassembly position. The protrusion 41' has a locking surface that is angled slightly to encourage the latch arm 45 to bias into a tighter locking relationship with the housing. In other words, the latch can be pushed from the fully locked to the preassembly position but not released from the connector housing unless special tooling is used.

As the actuator 72 extends alongside and is proximate or may even be in a contiguous relationship with side walls 75 of the terminal receiving portion 74, they are protected from damage and inadvertent actuation thereof even when in the fully locked position as shown in FIG. 4. A person can however easily access the actuator 72 with their fingers. The actuator 72 also provides a clear visual indication of the secondary locking member being in its fully locked position.

What is claimed is:

1. An electrical connector comprising a housing for receiving electrical terminals therein, and a secondary locking member mountable to the housing in a first preassembly position where the terminals can be inserted and locked in corresponding cavities, the secondary locking member movable to a fully locked position to securely lock the terminals in their corresponding cavities, the housing extending from a mating end that faces a complementary connector to be mated with the connector, to a terminal receiving end where the terminals are inserted into the cavities of the housing, the housing including an end wall located towards the terminal receiving end, the secondary locking member being mountable to the housing from the mating end, wherein the secondary locking member includes at least one actuator that projects through a cavity in the end wall when the secondary locking member is in the fully locked position, such that the actuator can be manually activated to move the secondary locking member from the fully locked to the preassembly position.

2. The connector of claim 1 wherein the secondary locking member and connector housing are provided with a pair of cooperating latching means, a first latching means securing the secondary locking member to the housing in the preassembly position such that the secondary locking member cannot be removed manually from the housing, and a second latching means that includes a latching protrusion having an oblique latching surface engagable by a complementary resilient latching member when the secondary locking member is in a fully locked position such that upon application of a releasing force on the actuator the resilient latches are biased over the latching protrusion.

3. The connector of claim 1 wherein a terminal receiving portion of the housing, within which the cavities are provided for receiving the terminals, extends beyond the end wall to the terminal receiving end, the actuator extending proximate and alongside the terminal receiving portion.

4. The connector of claim 3 wherein the actuator extends beyond the end wall when the secondary locking member is in the fully locked position.

5. The connector of claim 3 wherein the secondary locking member actuator is substantially within the connector housing when the secondary locking member is in the preassembly position.

6. The electrical connector of claim 1 wherein the connector further has a coupling assist member for assisting mating with the complementary connector, the coupling assist member and secondary locking member interengaging when the secondary locking member is in a preassembly position to prevent movement of the coupling assist member.

7. The connector of claim 6 wherein the coupling assist member comprises a locking shoulder which engages with a complementary locking arm of the secondary locking member when the secondary locking member is in the fully locked position and the coupling assist member is displaced from its preassembly position, such that the secondary locking member is prevented from displacement to the preassembly position.

8. The connector of claim 6 wherein the coupling assist member comprises a U-shaped body having a base wall and side walls extending laterally therefrom, the side walls are insertable through cutouts in a connector housing shroud to slide adjacent an inner surface thereof, the coupling member side walls having camming slots for receiving complementary studs of the complementary connector.

* * * * *